US005730050A

United States Patent [19]

Kato

[11] Patent Number: 5,730,050

[45] Date of Patent: Mar. 24, 1998

[54] INK BLOCKING MEMBER IN ROTARY STENCIL PRINTING MACHINE AND PRINTING DRUM HAVING THE SAME

[75] Inventor: Hiroyasu Kato, Tokyo, Japan

[73] Assignee: Riso Kagaku Corporation, Tokyo, Japan

[21] Appl. No.: 563,458

[22] Filed: Nov. 28, 1995

[30] Foreign Application Priority Data

Nov. 28, 1994 [JP] Japan ..... 6-293257

[51] Int. Cl.[6] ..... B41L 13/06

[52] U.S. Cl. ..... 101/116; 101/119

[58] Field of Search ..... 101/116, 119, 101/120, 128.1

[56] References Cited

U.S. PATENT DOCUMENTS 5,255,599 10/1993 Kobayasi et al. ..... 101/116

FOREIGN PATENT DOCUMENTS 57-51482 3/1982 Japan .
72895 5/1982 Japan ..... 101/128.1
199687 10/1985 Japan ..... 101/116
6199027 7/1994 Japan .

OTHER PUBLICATIONS

Patent Abstracts of Japan, vol. 018 No. 559 (M-1692), Oct. 25, 1994 & JP-A-06 199027 (Tohoku Ricoh Co., Ltd.), Jul. 19, 1994, *abstract.

Patent Abstracts of Japan, vol. 006 No. 124 (M-141), Jul. 9, 1982 & JP-A-57 051482 (Riso Kagaku Corp.) Mar. 6, 1982, *abstract.

*Primary Examiner*—Stephen R. Funk
*Attorney, Agent, or Firm*—Sughrue, Mion, Zinn, Macpeak & Seas, PLLC

[57] ABSTRACT

In an ink blocking member for a rotary stencil printing machine in which a printing drum has a printing region which is ink-permeable and a non-printing region which is not ink-permeable, for closing a part of the printing region, the ink blocking member is provided on the outer surface of the rear part of the printing region as viewed in the direction of rotation of the printing drum. The ink blocking member defines a space on the outer surface of the printing region of the printing drum which is opened in the direction of rotation of the printing drum, and which is communicated through the printing region with the inside of the printing drum. The ink blocking member is restorable in configuration to maintain the space constant in volume.

12 Claims, 9 Drawing Sheets

INK BLOCKING MEMBER IN ROTARY STENCIL PRINTING MACHINE AND PRINTING DRUM HAVING THE SAME

BACKGROUND OF THE INVENTION

1. Field of the Invention

This invention relates to a rotary stencil printing machine having a circular-cylinder-shaped printing drum which is rotated with a printing stencil wound on it, and more particularly to an ink blocking member in a rotary stencil printing machine of this type which prevents the leakage of ink from the rear end of the printing stencil wound on the printing drum.

2. Description of Related Art

FIG. 8 is a sectional view outlining the arrangement of a part of a conventional rotary stencil printing machine. In the printing machine, printing drum 4 has a cylindrical wall 2. The cylindrical wall includes a printing region having a number of tiny openings 18 through which printing ink passes (hereinafter referred to as "pores 18", when applicable); and a non-printing region having no such pores. A mesh-like screen 6 is wound on the outer surface of the cylindrical wall 2 of the printing drum 4. A printing stencil 8, which is obtained by thermally perforating a stencil paper with a thermal-head, is wound on the screen 6. On the other hand, a doctor roller 10 and a squeegee roller 12 are provided inside the printing drum 4 to hold printing ink. The printing ink 14 thus held is supplied to the inner cylindrical surface of the cylindrical drum 2 with the aid of the squeegee roller 12. A press roller 16 is provided outside the printing drum 4. The press roller 16 is adapted to press a printing sheet, which is supplied to the nipping region of the printing drum 4 and the press roller 16, against the stencil 8 wound on the printing drum 4, so that the printing ink is transferred onto the printing sheet to form a print.

In general, in the above-described rotary stencil printing machine, an ink blocking member 22 (as shown in FIG. 9) is provided on the part of the cylindrical wall 2 which is generally indicated at A in FIG. 8, corresponding to the rear end of the stencil wound on the drum. The ink blocking member 22 is made of a sheet of resin or the like. A half of the ink blocking member 22 covers the outer surface of the rear end part of the printing region as viewed in the direction of rotation of the printing drum 2, and the remaining half of the ink blocking member 22 is secured through an adhesive layer 23 to the outer surface of the cylindrical wall 2. The axial length (not indicated) of the ink blocking member 22 (measured in the direction of the axis of the printing drum) is larger than the length of the part of the printing region where the pores 18 are formed, thus covering the pores 18 in the direction of the axis of the printing drum. In FIG. 9, the screen (not shown) is wound over the ink blocking member 22 on the printing drum. The printing stencil (not shown) is wound on the outer surface of the screen in such a manner that, when viewed in the direction of the axis of the printing drum, the border line between the printing part and the non-printing part of the printing stencil is slightly (for instance about 10 mm) ahead of the front end of the ink blocking member 22 in the direction of rotation of the printing drum. The ink blocking member 22 is to close the pores 18 in the rear part of the printing region which are not used for the printing operation, and to prevent the printing ink from being supplied to the part of the screen which is in contact with the non-printing part of the printing stencil and to the non-printing part of the printing stencil.

In the printing operation with the above-described rotary stencil printing machine, the press roller 16 presses the printing sheet against the outer cylindrical surface of the printing drum 4 as was described above. On the other hand, the screen 6 wound on the printing drum 4 is impregnated with the printing ink. When, as shown in FIG. 9, the press roller 16 is moved in the direction of the arrow B with respect to the printing drum 4 while being rotated (in practice, the printing drum 4 is moved in the direction of the arrow R with respect to the press roller 16; however, for convenience in description of the behavior of the printing ink, it is assumed that the printing drum 4 is stationary), the ink contained in the screen 6 (not shown) is moved on the outer surface of the cylindrical wall 2 in the direction of the arrow C. When the quantity of the ink thus moved reaches a certain value, the ink is caused to flow over the ink blocking member 22; that is, it is moved on the outer surface of the blocking member 22 in the direction of the arrow D. Hence, as the printing operation is carried out repeatedly, the quantity of ink leaking over the outer surface of the ink blocking member 22 is increased. The ink thus leaked is collected on the rear side of the non-printing part of the printing stencil through the screen, finally being oozed from the rear edge and/or the side edges of the printing stencil. This difficulty may be eliminated by decreasing the quantity of ink contained in the screen 6. However, the method is not practical, because decreasing of the quantity of ink in the screen 6 gives rise to another difficulty that the resultant print has low picture density. In addition, the difficulty may be eliminated by a method in which the thickness of the ink blocking member is increased to prevent the ink from flowing over the ink blocking member. However, this method gives rise another problem. That is, if the thickness of the ink blocking member is increased, then the ink blocked by the front end of the ink blocking member tends to flow in the direction of the axis of the printing drum, leaking from both side edges of the stencil. In the case where no ink blocking member is employed, the border line between the printing part and the non-printing part of the printing stencil, which is wound on the outer surface of the cylindrical wall of the printing drum through the screen, is shifted a certain distance from the border line between the printing region and the non-printing region of the cylindrical wall towards the printing region, as viewed in the direction of the axis of the printing drum. In this case, when compared with the case where the ink blocking member is employed, the quantity of the ink flowing out from the rear part of the printing region in the direction of diameter of the printing drum is increased; that is, the ink is liable to leak from the rear edge of the printing stencil. Hence, the length of the non-printing part of the printing stencil must be increased as much as the quantity of outflow of ink is increased.

In the printing operation, the press roller 16 is driven to move to and from the printing drum 4 so as to press the printing part of the printing stencil wound on the printing drum and its small marginal parts which are located in front and in rear of the printing part against the printing drum through the printing sheet. When the stencil clamping section of the printing drum 4 passes by the press roller 16, the roller 16 is moved away from the printing drum 4.

SUMMARY OF THE INVENTION

In view of the foregoing, an object of the invention is to provide an ink blocking member for a rotary stencil printing machine which prevents the printing ink from oozing from the rear edge and/or side edges of the printing stencil wound on the printing drum, thus promising a stable printing operation.

According to a first aspect of the present invention, there is provided an ink blocking member for a rotary stencil printing machine in which a printing drum has a printing region which is ink-permeable and a non-printing region which is not ink-permeable, said ink blocking member closing a part of the printing region, characterized in that said ink blocking member is provided on the outer surface of the rear part of the printing region as viewed in the direction of rotation of the printing drum, and defines a space on the outer surface of the printing region of the printing drum which is opened in the direction of rotation of the printing drum, and is communicated through the printing region with the inside of the printing drum, and said ink blocking member is restorable in configuration to maintain said space constant in volume.

According to a second aspect of the invention, there is provided the ink blocking member of the first aspect comprising: a base member which is provided on the outer surface of the rear part of the printing region as viewed in the direction of rotation of the printing drum, and has a plurality of protruded pieces arranged over the printing region of the printing drum at predetermined intervals; and an elastic cover member which is provided over said base member to form spaces with said protruded pieces and the outer surface of the printing region of the printing drum.

According to a third aspect of the invention, there is provided the ink blocking member of the first aspect comprising: a leaf spring member which is provided on the outer surface of the rear part of the printing region of the printing drum as viewed in the direction of rotation of the printing drum, and defines a space on the outer surface of the printing region of the printing drum.

During the printing operation, the ink is caused to flow over the outer cylindrical surface of the printing drum in the direction opposite to the direction of rotation of the printing drum. However, the ink flows into the space which is formed between the outer cylindrical surface of the printing drum and the ink blocking member; that is, it will not leak to the outer surface of the ink blocking member. When, during the printing operation, the ink blocking member is pushed by the press roller, the ink in the space is returned through the pores formed in the cylindrical wall of the printing drum into the inside of the latter; that is, the ink in the space will never leak to the outer surface of the ink blocking member.

DETAILED DESCRIPTION OF THE PREFERRED EMBODIMENTS

Figure 1:
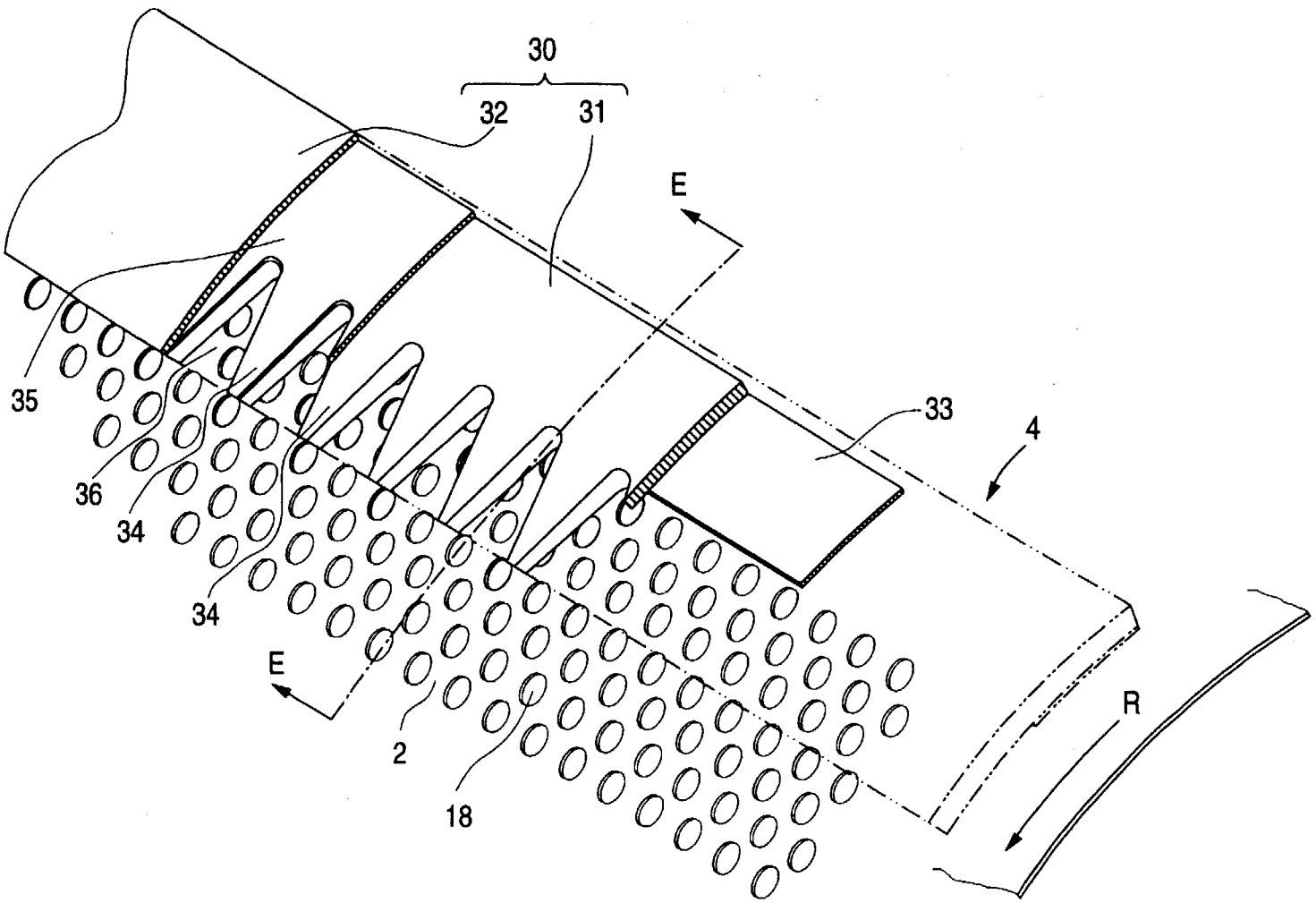
FIG. 1 is a perspective view showing an embodiment of an ink blocking member according to the invention.

Preferred embodiments of the invention will be described with reference to FIGS. 1 through 7. The fundamental arrangement of a rotary stencil printing machine to which each of the embodiments is applied, is similar to that which has been described with reference to the conventional one, and the structure of the printing drum in the printing machine is as shown in FIG. 8. In FIGS. 1 through 7, the screen is not shown.

The first embodiment will be described with reference to FIGS. 1 and 2. An ink blocking member 30 is provided on the outer surface of the printing region of the cylindrical wall 2 of the printing drum 4. More specifically, it is located downstream of the printing region of the cylindrical wall 2 as viewed in the direction of rotation of the printing drum 4 (in the direction of the arrow R). The ink blocking member 30 includes: a base member 31; and a cover member 32.

The base member 31 is substantially in the form of a rectangular plate of resin having a predetermined thickness. The base member 31 is mounted on the outer surface of the cylindrical wall 2 in such a manner that the base member 31 extends in parallel with the central axis of the printing drum 4. The length of the base member 31, measured in the direction of the axis of the printing drum 4, is so determined that the base member 31 covers the pores 18 in the direction of the axis of the printing drum 4. This may be said of the other embodiments (described later). The rear half of the base member 31, as viewed in the direction of rotation R of the printing drum 4, is fixedly secured through an adhesive layer 33 to the outer surface of the non-printing region of the cylindrical wall 2. The front half of the base member 31, as viewed in the direction of rotation R of the printing drum 4, partially covers the outer surface of the printing region of the cylindrical wall 2; more specifically, it covers a part of the rear portion of the printing region. The front half of the base member 31 has a plurality of substantially triangular protruded pieces 34 in such a manner that those protruded pieces 34 are arranged over the printing region of the cylindrical wall 2 at predetermined intervals.

The cover member 32 is in the form of a thin plate which is elastic or restorable, and is made of resin or metal. The cover member 32 is secured with an adhesive layer 35 on the base member 31.

The cover member 32, the protruded pieces 34, 34, 34, . . . of the base member 31, and the outer surface of the printing region of the printing drum 4 define a plurality of spaces 36 which are adapted to hold printing ink (hereinafter referred to as "ink holding spaces 36", when applicable). More specifically, those spaces 36 are located on the outer surface of the rear part of the printing region of the printing drum 4 as viewed in the direction of rotation R of the printing drum 4.

The embodiment functions as follows: In the printing operation, the ink which is oozed out being pushed by the press roller 16 is caused to flow on the outer cylindrical surface of the printing drum 4 backwardly as viewed in the direction of rotation R of the printing drum 4; i.e., in the direction opposite to the direction of rotation R of the printing drum 4 (hereinafter referred to as "the reverse direction", when applicable). However, the ink flows into the spaces 36 which are defined by the outer cylindrical surface of the printing drum 4 and the ink blocking member 30 as was described above, thus being prevented from flowing to the outer surface of the ink blocking member 30. When, in the printing operation, the cover member 32 of the ink blocking member 30 is pressed by the press roller 16, the cover member 32 is elastically inwardly bent, thus decreasing the volumes of the ink holding spaces 36. As a result, the ink in those spaces 36 is returned through the pores 18 into the printing drum 4; that is, the ink in the spaces 36 is prevented from flowing to the outer surface of the ink blocking member 30. As was described above, the cover member 32 is elastic or restorable. Hence, when the press roller 16 is released, the cover member 32 is restored in configuration, and accordingly the volumes of the ink holding spaces 36 are also restored.

Figure 2:
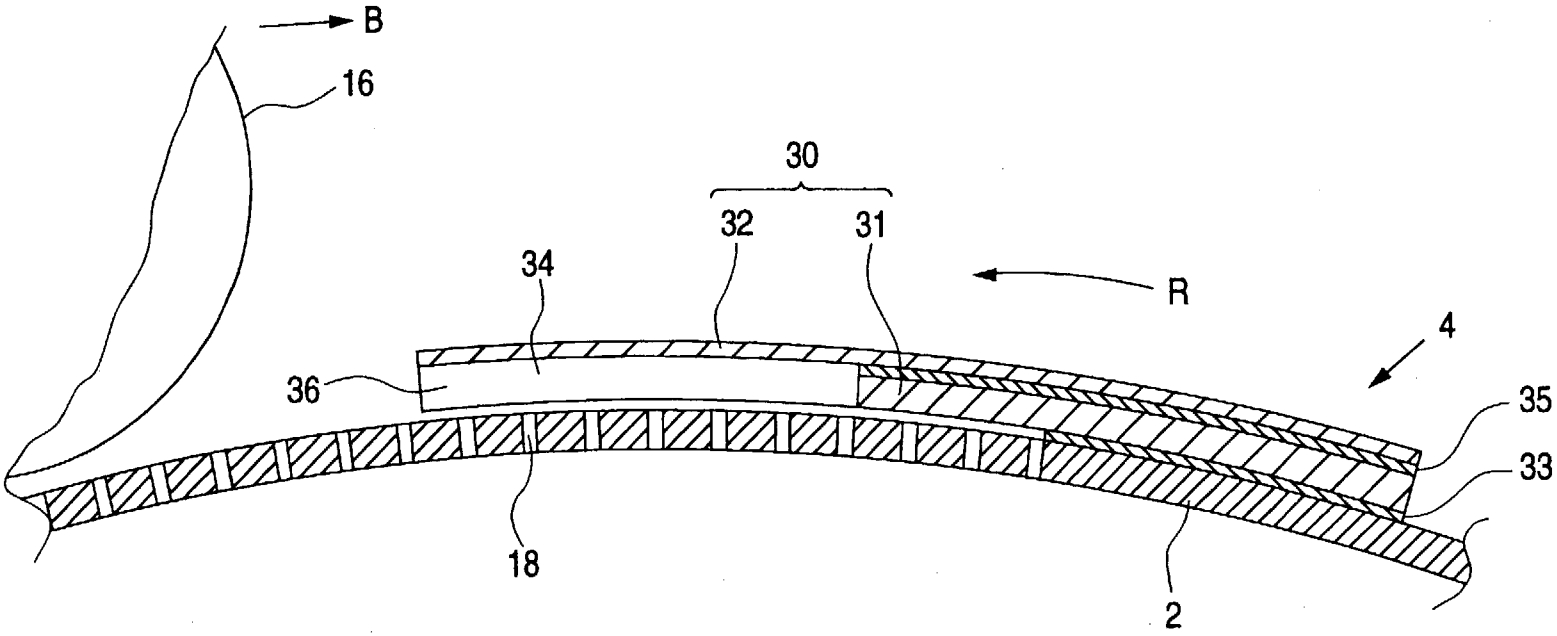
FIG. 2 is a sectional view taken along line E—E in FIG. 1.
Figure 3:
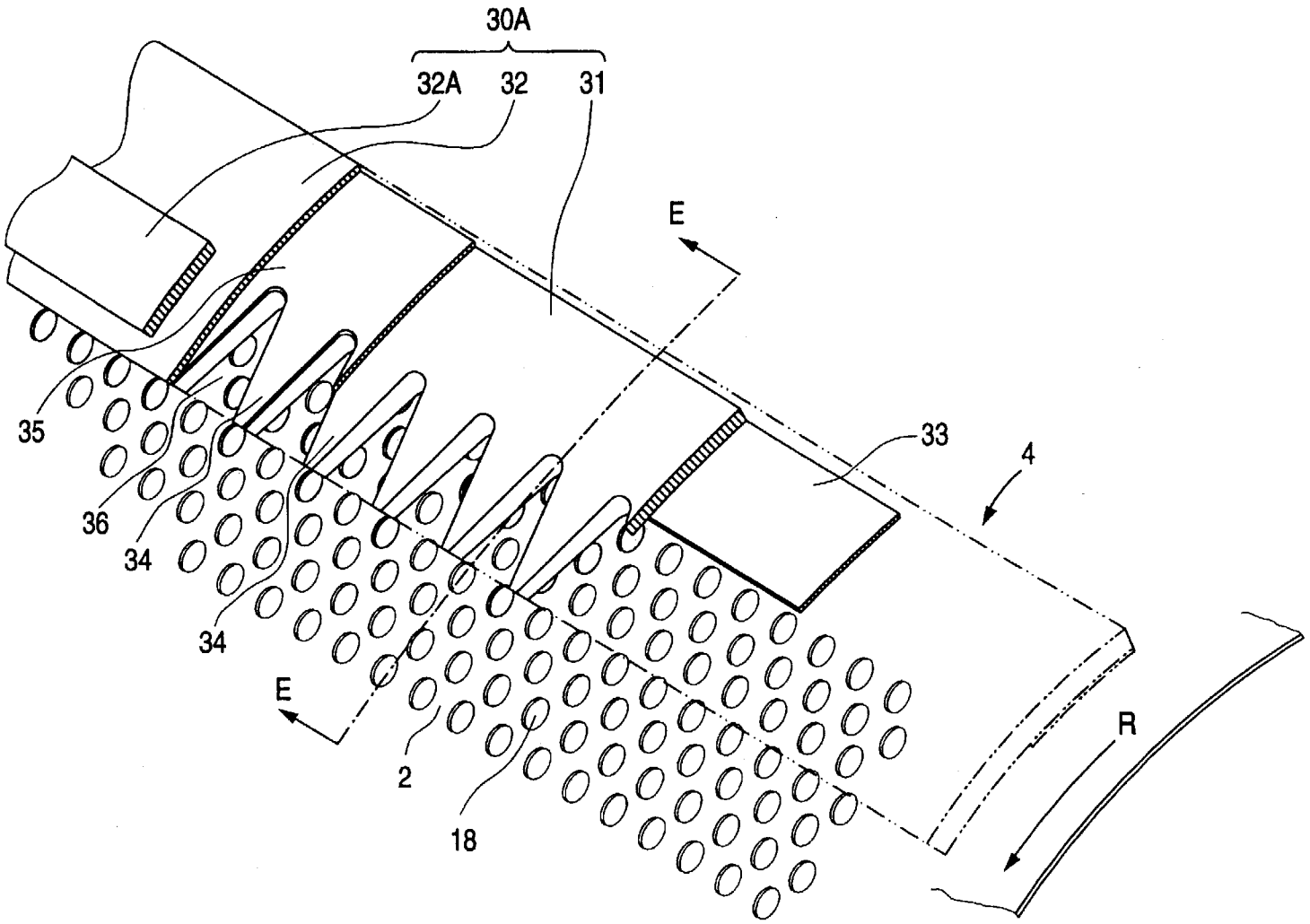
FIG. 3 is a perspective view showing one modification of the ink blocking member shown in FIGS. 1 and 2.
Figure 4:
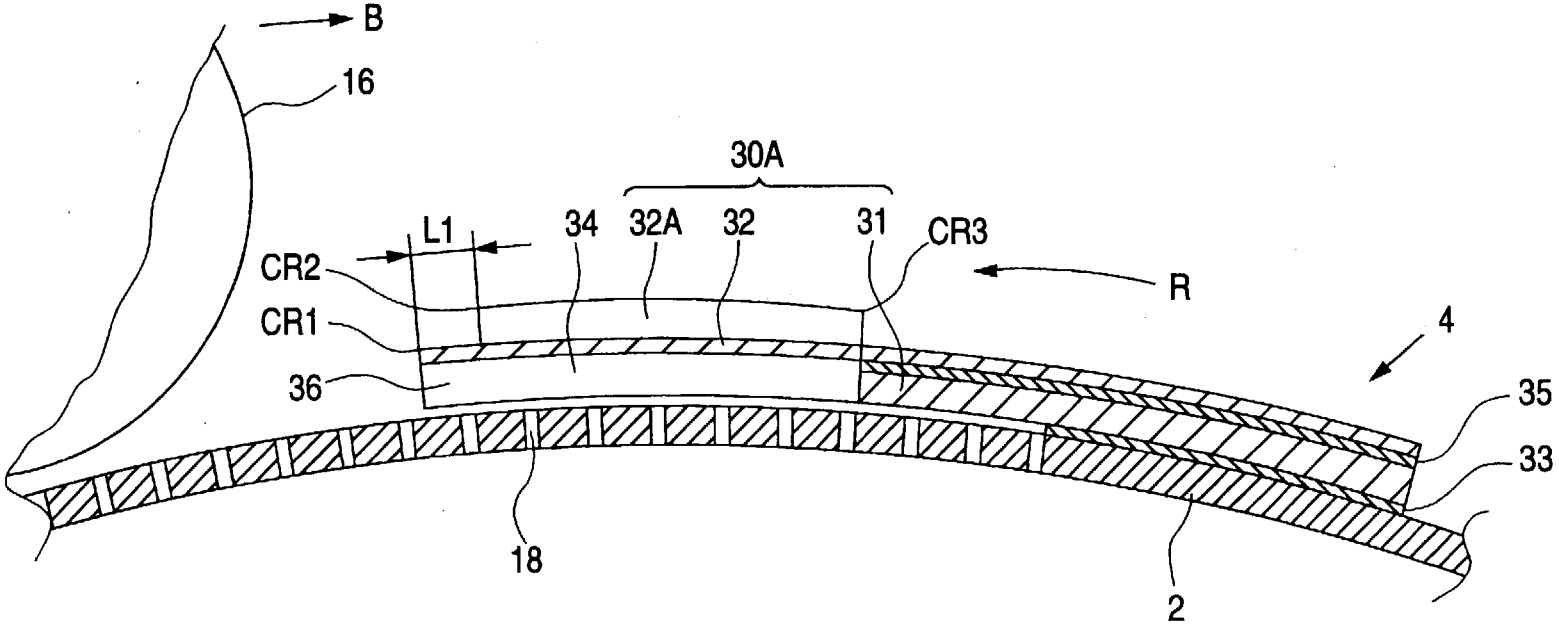
FIG. 4 is a sectional view taken along line E—E in FIG. 3.

The ink blocking member shown in FIGS. 1 and 2 may be modified as shown in FIGS. 3 and 4. The ink blocking member 30A shown in FIGS. 3 and 4 is different from the one shown in FIGS. 1 and 2 in that an elastic member 32A of silicon rubber or the like is bonded to the outer surface of the cover member 32. In a sectional view perpendicular to the central axis of the printing drum 4; that is, in FIG. 4, the front end CR2 of the elastic member 32A is retracted as much as a small distance L1 from the front end CR1 of the cover member in the direction opposite to the direction of rotation of the printing drum 4. The small distance L1 is so selected that, when the press roller 16 is rolled on the outer cylindrical surface of the printing drum 4, it contacts both the front end CR1 of the cover member 32 and the front end CR2 of the elastic member 32A. On the other hand, the rear end CR3 of the elastic member 32A is substantially flush with the rear ends of the ink holding spaces 36. It is not always necessary to firmly bond the elastic member 32A to the outer surface of the cover member 32; however, it should be bonded to the cover member 32 to the extent that the elastic member 32A is prevented from being shifted from the cover member 32.

In the ink blocking member 30A, the rigidity is increased by the addition of the elastic member 32A. Hence, when the press roller 16 rides on the ink blocking member, it less deforms the front end CR1 of the cover member 32, and accordingly the quantity of ink which flows to the outer surface of cover member 32 is decreased. When the press roller 16 abuts against the front end CR1 of the over member 32, it simultaneously abuts against the front end CR2 of the elastic member 32A and the outer cylindrical surface of the printing drum 4, which decreases the amount of deformation of the front end CR1 of the cover member 32. Furthermore, even in the case where the ink flows on the cover member being squeezed by the press roller 16, it is not allowed to flow to the elastic member 32A being blocked by the bank which is provided by the front end of the elastic member 32A.

Figure 5:
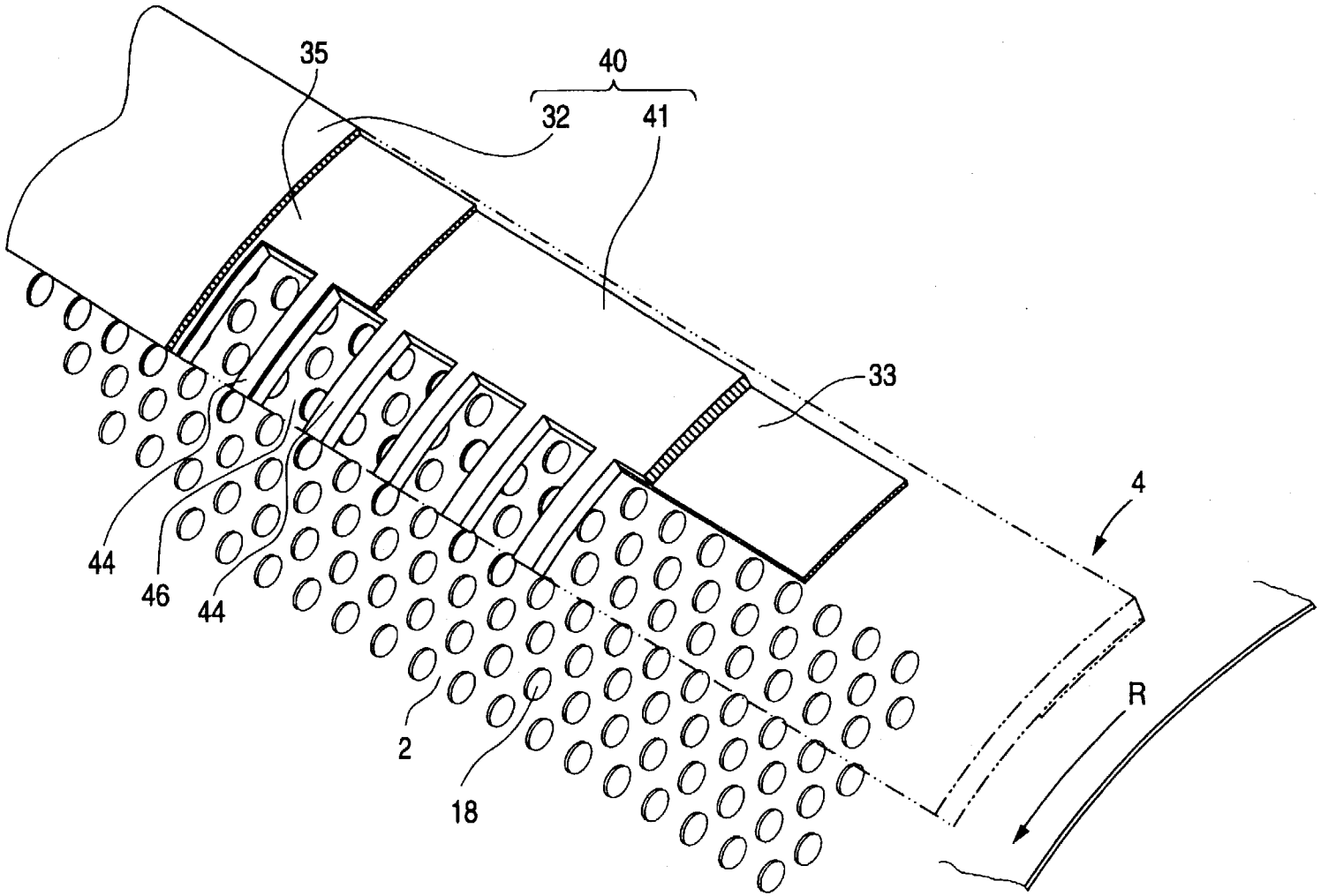
FIG. 5 is a perspective view showing another embodiment of the ink blocking member according to the invention.

Another embodiment of the invention is as shown in FIG. 5.

The embodiment is similarly in fundamental structure to the above-described first embodiment; however the former is different from the latter as follows: In this embodiment, an ink blocking member 40 comprises a base member 41, and a cover member 32. The base member 41 has a number of rectangular protruded pieces 44 which are arranged in a line at predetermined intervals. Those rectangular protruded pieces 44, the upper surface of the base member 41, and the lower surface of the cover member 32 on the base member 41 define a number of ink holding spaces 46. Hence, this embodiment has the same function and effect as the above-described first embodiment.

Figure 6:
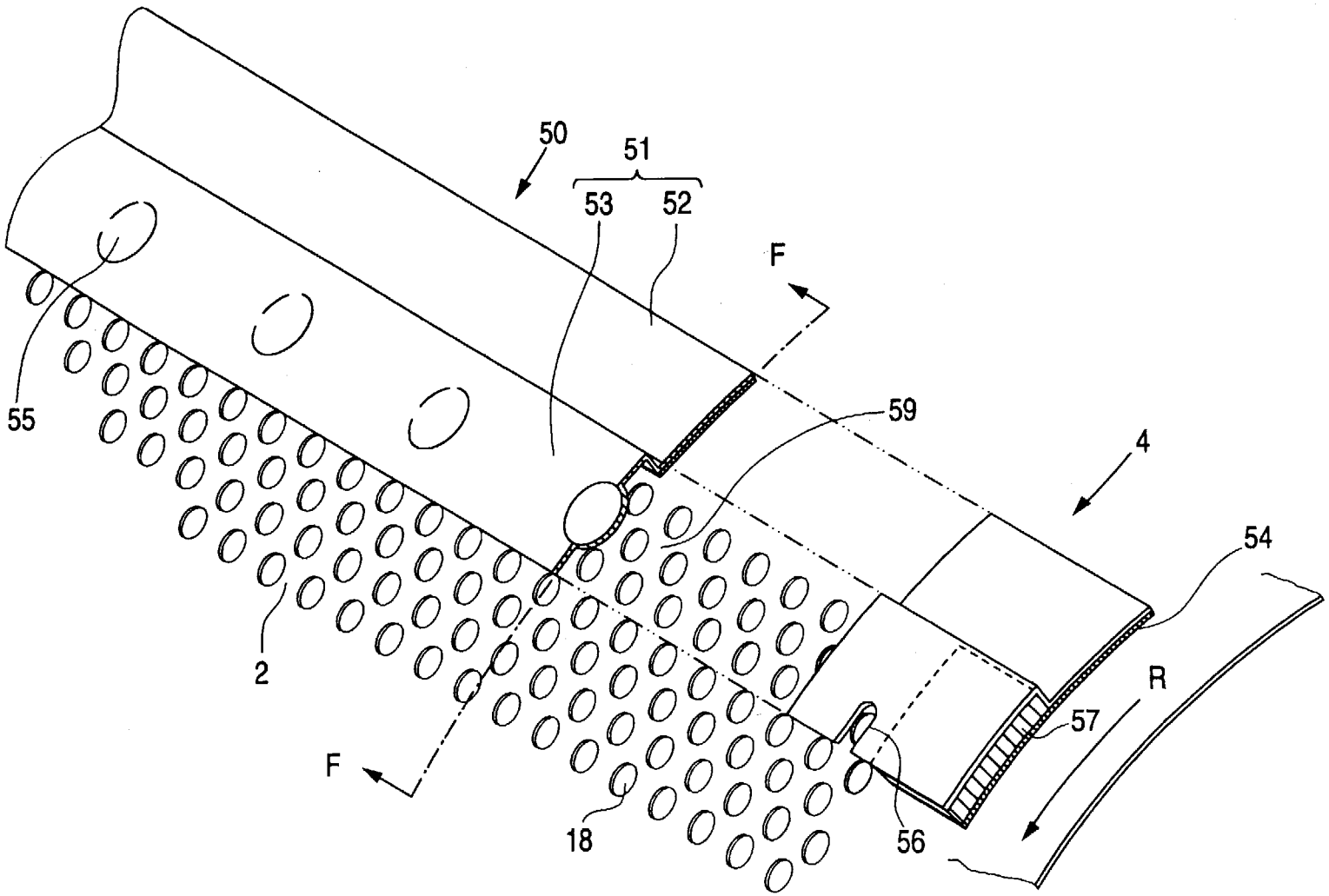
FIG. 6 is a perspective view showing still further embodiment of the ink blocking member according to the invention.

Still further embodiment of the invention will be described with reference to FIGS. 6 and 7. In this embodiment, an ink blocking member 50 is provided on the rear part of the outer surface of the printing region of the printing drum 4 as viewed in the direction of rotation of the printing drum (or in the direction of the arrow R) in which a number of pores 18 are formed. The ink blocking member 50 includes a leaf spring member 51 which is substantially rectangular, and has a predetermined elasticity being made of metal or resin. The leaf spring member 51 is mounted on the outer surface of the cylindrical wall 2 of the printing drum 4 in such a manner that it is in parallel with the central axis of the printing drum 4.

The rear half of the leaf spring member 51, as viewed in the direction of rotation R of the printing drum 4, has a mounting part 52 which is fixedly mounted through an adhesive layer 54 on the outer surface of the non-printing region of the cylindrical wall 2. The front half of the leaf spring member 51, as viewed in the direction of rotation R of the printing drum 4, has an elastic part 53 which is raised from the mounting part 52. The elastic part 53 is spaced a predetermined distance from the rear end portion of the printing region as viewed in the direction of rotation R of the printing drum 4.

The elastic part 53 has protrusions 55 which are curved toward the printing drum 4. The protrusions 55 are abutted against the outer surface of the cylindrical wall 2 of the printing drum 4, so that the elastic part 53 is spaced from the cylindrical wall 2 as described above. More specifically, the protrusions 55 are semi-spherical, and integral with the elastic part 53.

The elastic part 53 has cuts 56 in its front end portion as viewed in the direction of rotation R of the printing drum 4 so that the elastic part 53 may be readily bent.

Rectangular-parallelepiped-shaped closing members 57 are provided between the outer surface of the cylindrical wall 2 of the printing drum 4 and both end portions of the elastic part 53, to close the gaps between the lower surfaces of both end portions of the elastic part 53 and the outer surfaces of both end portions of the cylindrical wall 2.

Figure 7:
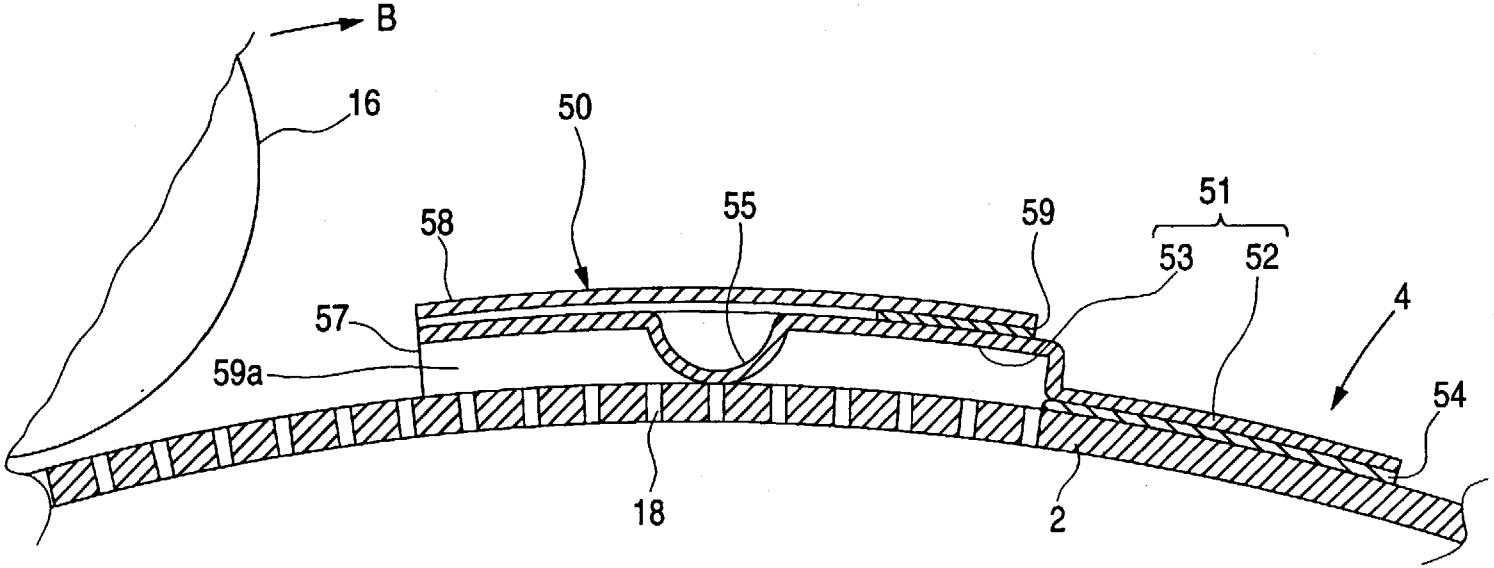
FIG. 7 is a sectional view taken along line F—F in FIG. 6.
Figure 8:
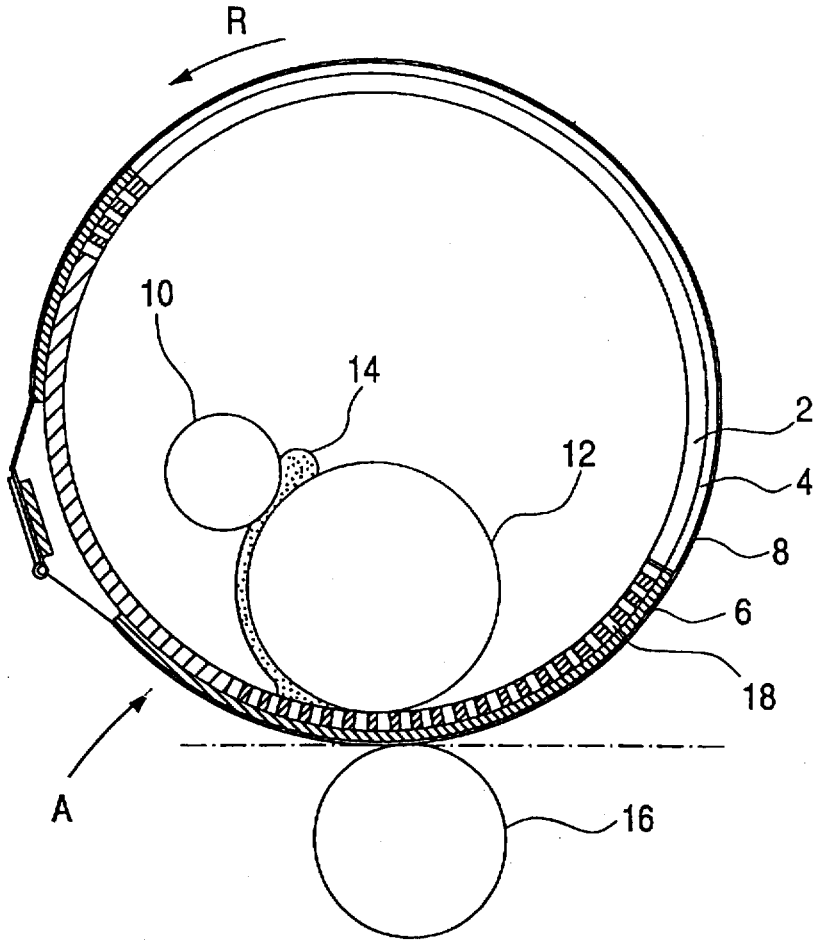
FIG. 8 PRIOR ART
FIG. 8 is a diagram outlining the arrangement of a general rotary stencil printing machine.
Figure 9:
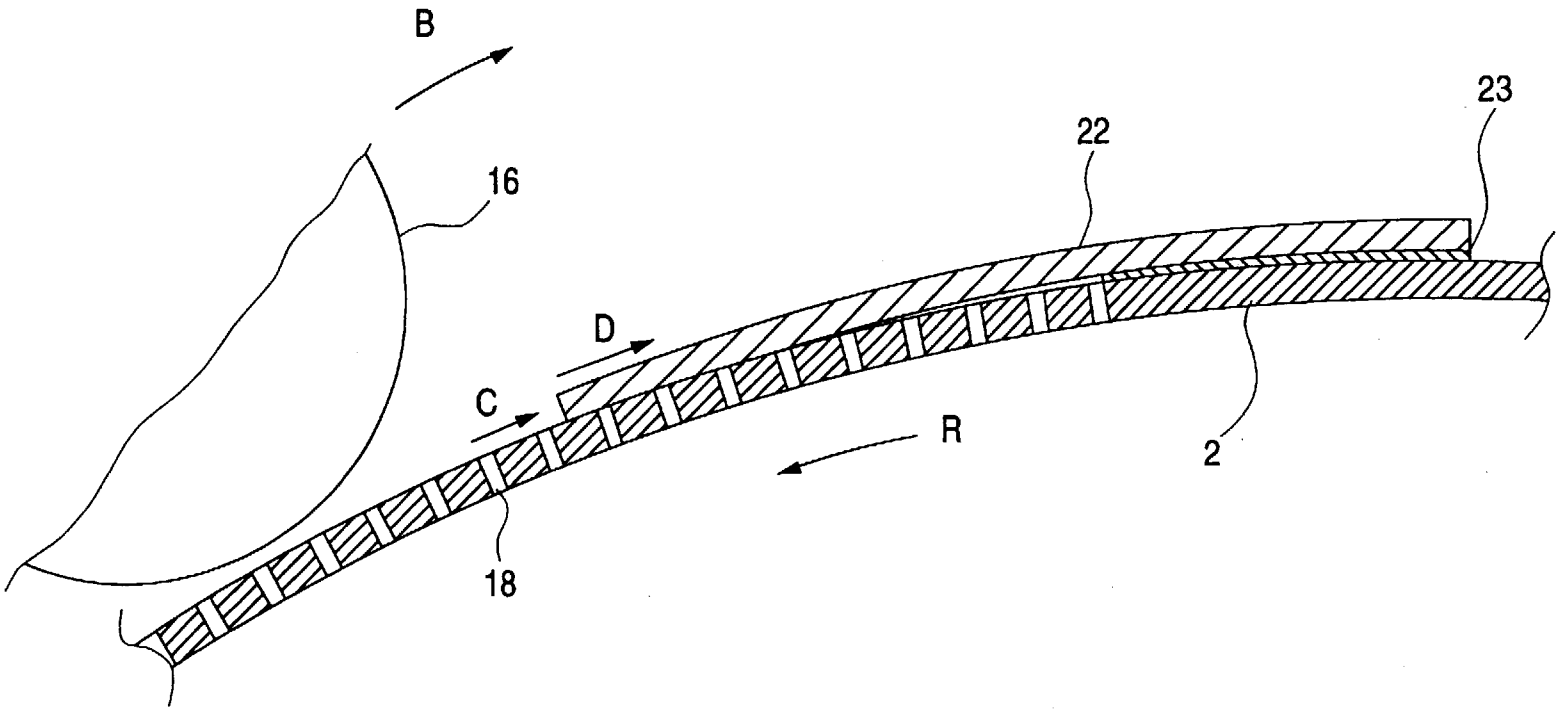
FIG. 9 is a sectional view of a conventional ink blocking member.

As shown in FIG. 7 (not shown in FIG. 6), a cover member 58 is provided over the elastic part 53. The cover member 58 is in the form of a thin plate, and it is bonded to the elastic member 53 through an adhesive layer 59. More specifically, the cover member 58 covers the aforementioned cuts 56, and the recesses which are formed in the upper surface of the elastic member 53 by the downwardly curved protrusions 55.

The elastic part 53 of the leaf spring member 51 covered with the cover member 58, the closing members 57 and 57, and the outer surface of the printing region of the printing drum 4 define an ink holding space 59*a* which holds the printing ink. The ink holding space 59*a* is located on the outer surface of the rear part of the printing region of the printing drum 4 as viewed in the direction of rotation R of the drum 4.

In the embodiment, the ink oozed out by the pressure of the press roller is caused to flow to the outer cylindrical surface of the printing drum 4 in the direction opposite to the direction of rotation R of the printing drum 4. However, the ink flows into the space 59*a* which is formed between the outer cylindrical surface of the printing drum 4 and the elastic part 53 of the leaf spring member 51; that is, it will not leak over the outer surface of the ink blocking member 50. When, during the printing operation, the elastic part 53 of the ink blocking member 50 is pushed by the press roller 16, the elastic part 53 is elastically bent inwardly of the printing drum, thus decreasing the volume of the space 59*a*. As a result, the ink in the space 59*a* is returned through the pores 18 into the inside of the printing drum; that is, the ink in the space 59*a* will never leak to the outer surface of the ink blocking member 50. The elastic member 53 is restored in configuration by its own elasticity. Hence, when the press roller 16 is moved away from the elastic member 53, the latter is restored; that is, the volume of the space 59*a* is restored.

With the ink blocking member of the invention, the ink is prevented from oozing from the rear edge and/or side edges of the printing stencil wound on the printing drum, thus promising a stable printing operation.

What is claimed is:

1. An ink blocking member for a rotary stencil printing machine in which a printing drum has a printing region which is ink-permeable and a non-printing region which is not ink-permeable, comprising:

a base member having a mounting part mountable on the non-printing region of the printing drum, and an ink collecting part having a plurality of protruded pieces arranged so that when said mounting part is mounted on the non-printing region, said protruded pieces extend over the printing region of the printing drum; and an elastic cover member which is provided over said base member and covers said protruded pieces to thereby define ink holding spaces.

2. The ink blocking member of claim 1, further comprising an elastic block member which is narrower than the elastic cover member and is provided on an area of the elastic cover member which covers the protruded pieces.

3. The ink blocking member of claim 2, wherein the elastic block member is recessed from a leading edge of the elastic cover member.

4. An ink blocking member for a rotary stencil printing machine in which a printing drum has a printing region which is ink-permeable and a non-printing region which is not ink-permeable, comprising:

a leaf spring member having a mounting part which is mountable on the non-printing region of the printing drum, and an elastic part which is raised from the mounting part and which has protrusions curved toward the printing drum so that the elastic part is spaced from the printing region of the printing drum so as to define an ink holding space; and a pair of closing members providable between the printing region of the printing drum and both end portions of the elastic part, to close gaps between an outer surface of the printing region of the printing drum and lower surfaces of both end portions of the elastic part.

5. The ink blocking member of claim 4, wherein two notches are respectively provided on two leading edge corners of the elastic part of the leaf spring member.

6. An ink blocking member according to claim 4, wherein two notches are respectively formed on two leading edge corners of the elastic part of the leaf spring member, and an elastic cover is provided on the elastic part of the leaf spring member.

7. A printing drum for a rotary stencil printing machine comprising:

a cylindrical wall having a printing region which is ink-permeable, and a non-printing region which is not ink-permeable; and an ink blocking member provided on the rear part of said printing region as viewed in the direction of cylindrical wall for closing said printing region in part, wherein said ink blocking member comprises:

a base member having a mounting part mountable on the non-printing region of the cylindrical wall and an ink collecting part having a plurality of protruded pieces arranged so that when said mounting part is mounted on the non-printing region of the cylindrical wall, said protruded pieces extend over the printing region of the cylindrical wall; and an elastic cover member which is provided over said base member and covers said protruded pieces to thereby define ink holding spaces.

8. The printing drum according to claim 7, wherein said ink blocking member further comprises:

an elastic block member which is provided on the elastic cover member over an area of said ink collecting part which covers said protruded pieces.

9. The printing drum according to claim 8, wherein said elastic block member is narrower than said elastic cover member, and is recessed from a leading edge of the elastic cover member.

10. A printing drum for a rotary stencil printing machine comprising:

a cylindrical wall having a printing region which is ink-permeable, and a non-printing region which is not ink-permeable; and an ink blocking member provided on the cylindrical wall for closing said printing region in part, wherein said ink blocking member comprises:

a leaf spring member having a mounting part which is mountable on the non-printing region of the cylindrical wall, and an elastic part which is raised from the mounting part and which has protrusions curved toward the cylindrical wall so that the elastic part is spaced from the printing region of the cylindrical wall so as to define an ink holding space; and a pair of closing members providable between the printing region of the cylindrical wall and both end portions of the elastic part, to close gaps between an outer surface of the printing region of the cylindrical wall and lower surfaces of both end portions of the elastic part.

11. The printing drum according to claim 10, wherein two notches are respectively provided on two leading edge corners of the elastic part of the leaf spring member.

12. A printing drum for a rotary stencil printing machine according to claim 10, wherein two notches are respectively formed on two leading edge corners of the elastic part of the leaf spring member, and an elastic cover is provided on the elastic part of the leaf spring member.

* * * * *